US006497608B2

(12) United States Patent
Ho et al.

(10) Patent No.: US 6,497,608 B2
(45) Date of Patent: Dec. 24, 2002

(54) TOY CAR CAMERA SYSTEM AND REAR VISION MIRRORS

(75) Inventors: Heng-Chun Ho, Taipei (TW); Shu-Ming Liu, Taipei (TW)

(73) Assignee: Sampo Technology Corp., Tao-Yuan Hsien (TW)

( * ) Notice: Subject to any disclaimer, the term of this patent is extended or adjusted under 35 U.S.C. 154(b) by 7 days.

(21) Appl. No.: 09/803,894

(22) Filed: Mar. 13, 2001

(65) Prior Publication Data

US 2002/0111117 A1 Aug. 15, 2002

(30) Foreign Application Priority Data

Feb. 9, 2001 (TW) ..... 090102968

(51) Int. Cl.[7] ..... G08C 19/16
(52) U.S. Cl. ..... 446/456; 348/114
(58) Field of Search ..... 446/454, 456, 446/431, 457, 460, 462; 340/825.69, 825.72; 348/114

(56) References Cited

U.S. PATENT DOCUMENTS 5,127,658 A * 7/1992 Openiano ..... 446/130
5,481,257 A * 1/1996 Brubaker et al. ..... 340/825.69
6,293,798 B1 * 9/2001 Boyle et al. ..... 434/29
2001/0010993 A1 * 8/2001 Maleika
2001/0045978 A1 * 11/2001 McConnell et al.

* cited by examiner

*Primary Examiner*—Jacob K. Ackun
(74) *Attorney, Agent, or Firm*—Winston Hsu

(57) ABSTRACT

A remote control toy car set comprising a toy car with a housing having a driving device, a camera system, and a first radio module. The camera system is fixed on the housing for taking images of the toy car in motion and generating corresponding image signals, and the first radio module is fixed on the housing and electrically connects with both the driving device and the camera system. The first radio module transfers the image signals from the camera system and receives radio control signals in order to control the operations of the driving device. The remote control toy car set also includes a remote control device for controlling the toy car. The remote control device includes a display for displaying images, a remote control interface for generating control signals, and a second radio module for transferring both the image signals from the toy car to the display and the control signals from the remote control interface to the toy car.

4 Claims, 7 Drawing Sheets

TOY CAR CAMERA SYSTEM AND REAR VISION MIRRORS

BACKGROUND OF THE INVENTION

1. Field of the Invention

The present invention relates to a remote control toy car set, and more particularly, to a remote control toy car set with both cameras and rear vision mirrors.

2. Description of the Prior Art

Traditional remote control toy car sets generally include a toy car and a remote control device. Housing of the toy car includes a driving module electrically connected to a first radio module. The remote control device includes a second radio module and a remote control module. The remote control module generates remote control signals, which are then received by the second radio module to be transferred out. The first radio module within the toy car receives remote control signals and transfers them to the driving device in order to control the operations of the toy car.

However, it is impossible for users of the toy car to have the sensation of actually being behind the wheel of the car. As well, the experience of controlling the toy car is not as real as playing a video game such as cart racing.

SUMMARY OF THE INVENTION

It is an object of the present invention to provide a toy car set with cameras and rear vision mirrors in order to provide users of the toy car with the experience of actually being behind the wheel.

In accordance with the claimed invention, a remote control toy car set comprises a toy car with a housing that includes a driving device, and both a camera system and a first radio module fixed on the housing. The camera system functions in taking images of the toy car in motion and generating corresponding image signals. The first radio module electrically connects with both the driving device and the camera system for transferring of the image signals from the camera system and receiving radio control signals in order to control the operations of the driving device. The remote control toy car set also includes a remote control device for controlling the toy car.

It is an advantage of the present invention that a toy car is provided with cameras and rear vision mirrors for displaying to the user, images ahead and behind the toy car while controlling the operations of the toy car just as if the user was actually driving the car.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
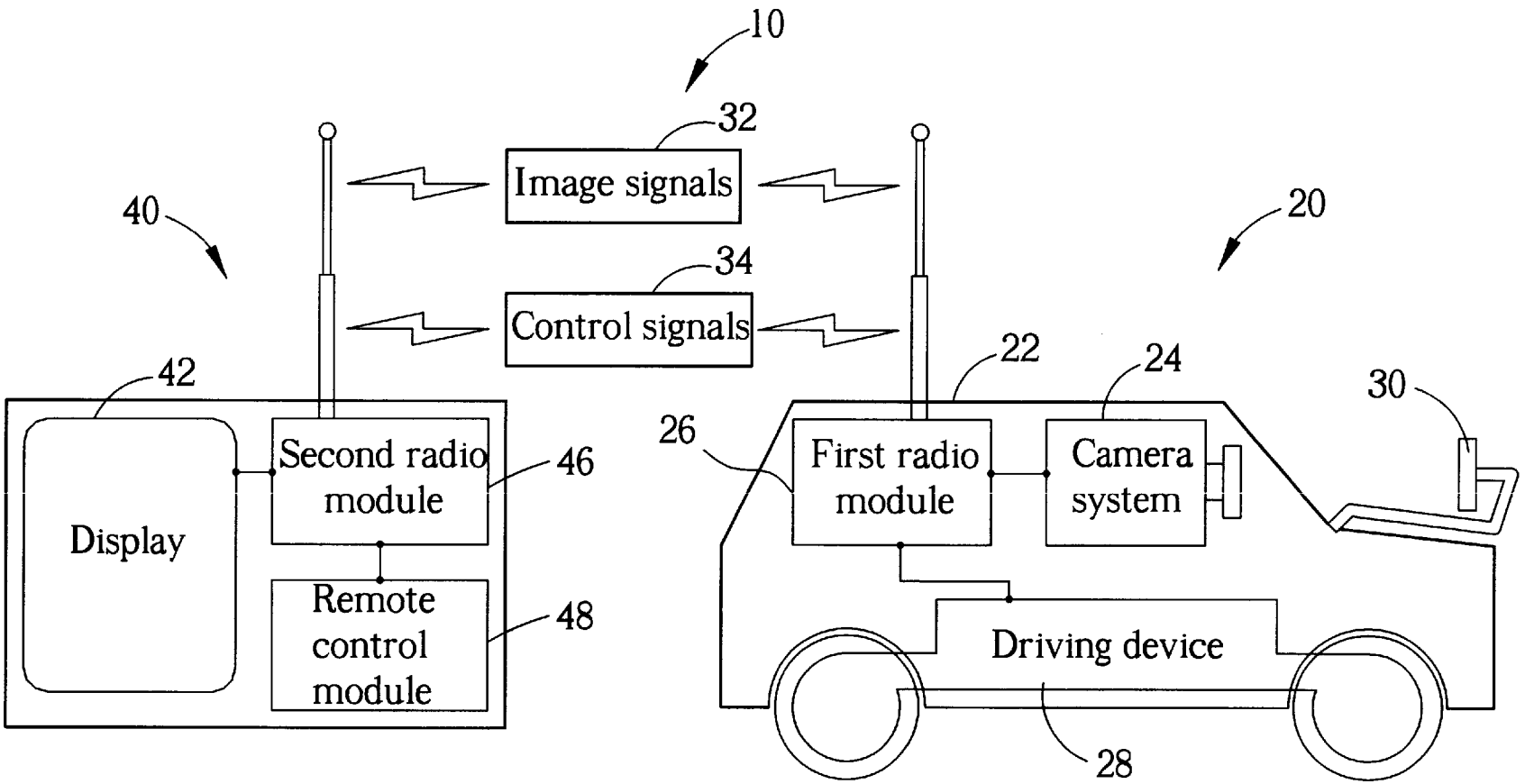
FIG. 1 is a block diagram of a toy car set according to the present invention.

Please refer to FIG. 1 of a block diagram of a toy car set 10 according to the present invention. The toy car set 10 includes two main portions, a toy car 20 and a remote control device 40. The toy car 20 includes a housing 22 driven by a driving device 28. The most significant characteristic of the toy car 20 of the present invention is the setting of the camera system 24 on the toy car 20, and the driving device 28 and the camera system 24 both electrically connect with a first radio module 26 within the toy car 20. Also, the housing 22 of the toy car 20 further includes rear vision mirrors 30.

The remote control device 40 includes a display 42 and a remote control module 48, whereby both are electrically connected with the second radio module 46 within the remote control device 40.

When controlling the toy car set 10, the user controls the operations of the toy car 20 by the remote control module 48 of the remote control device 40. The remote control module 48 generates control signals 34 corresponding to the user's command which are then sent to the second radio module 46 electrically connected with the remote control module 48. Then, the second radio module 46 transfers the control signals 34 to the first radio module 26 of the toy car 20, as shown as FIG. 1, which are then received by the driving device 28 to control the operations of the toy car 20.

For additional gaming pleasure, the toy car 20 of the remote control toy car set 10 sets a camera system 24 aligned in the movement direction of the toy car 20. The adoption of CCD cameras for the camera system 24 dramatically reduces size and weight of the camera system 24 so that it can be set on the toy car 20 to guarantee image quality. The images taken by the camera system 24 are transferred to the first radio module 26 as image signals 32. Then, the first radio module 26 transfers the image signals 32 to the second radio module 46 of the remote control device 40. The second radio module 46 receives the image signals 32 and transfers them to the display 42 for self-display of the image signals 32. Thus, the user can monitor what is ahead of the toy car 20 by the display 42 of the display device 40 and control the operations of the toy car 20 by the remote control device 48. The setting of rear vision mirrors 30 allows for the reflection of what is behind the toy car 20 to the camera system 24, and by this arrangement, users can monitor what is ahead and behind the toy car 20.

Figure 2:
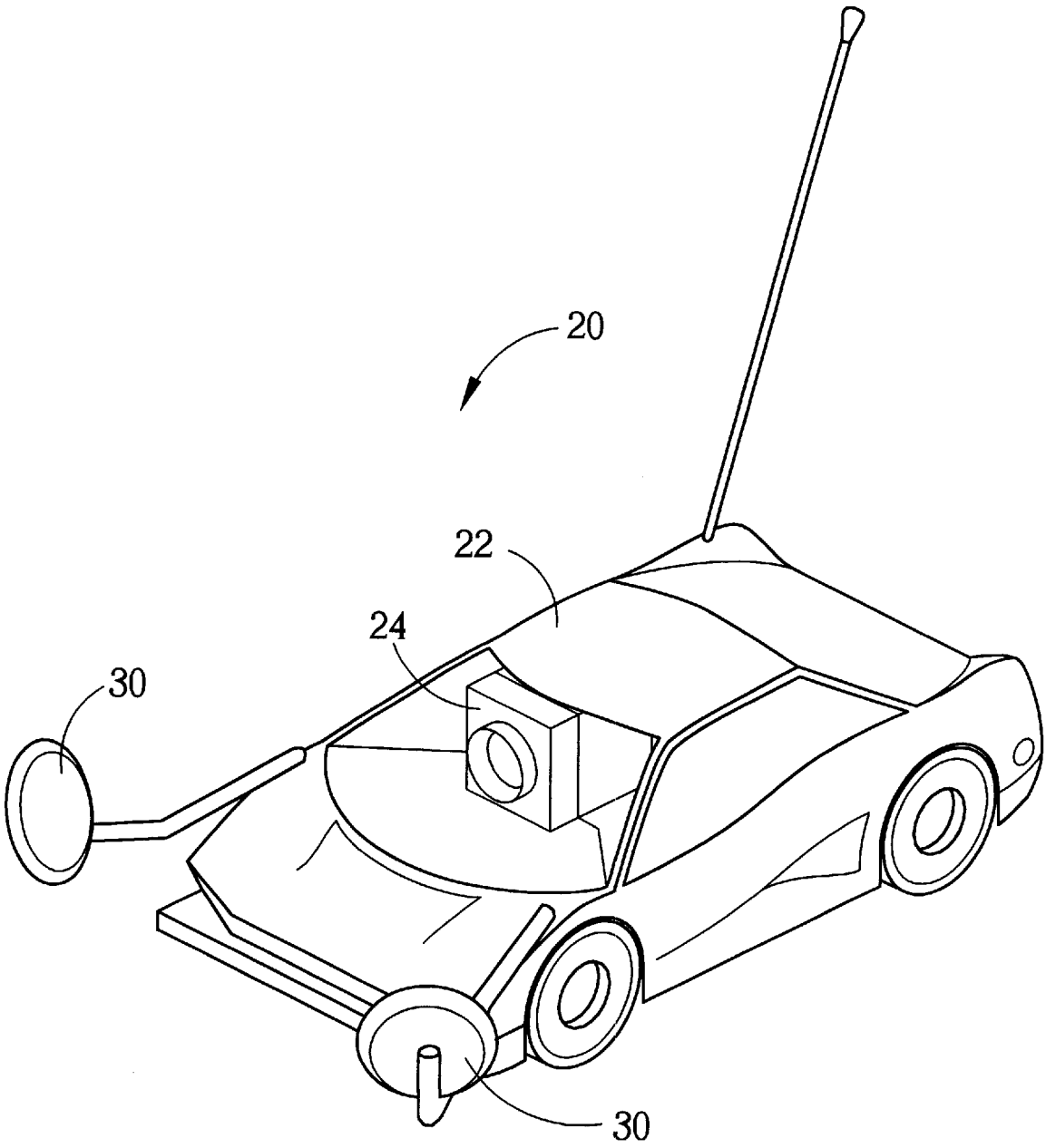
FIG. 2 is a schematic diagram of a toy car of the toy car set according to the present invention.

Please refer to FIG. 2 of a schematic diagram of an embodiment of the toy car 20. The lenses of the camera system 24 are aligned with the movement direction of the toy car 20 and are fixed on the housing 22. Rear vision mirrors 30 are set in cooperation with the camera system 24 to reflect what is behind the toy car 20 to the camera system 24.

Figure 3:
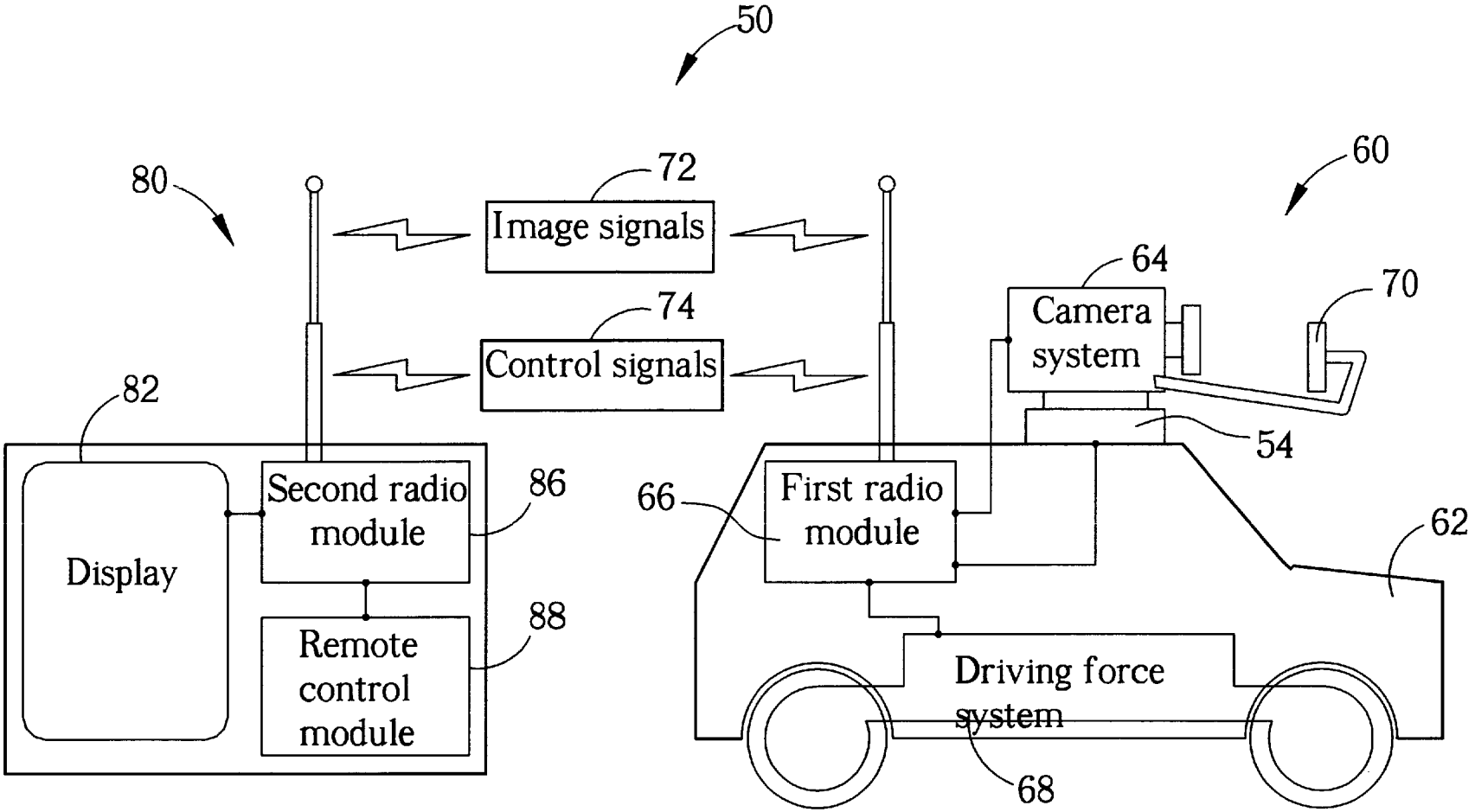
FIG. 3 is a block diagram of the second embodiment of the toy car set according to the present invention.

Please refer to FIG. 3 of a block diagram of another embodiment 50 of the present invention. The toy car set 50 includes a toy car 60 and a remote control device 80. The toy car 60 includes a first radio module 66 electrically connected with a driving force device 68, a camera system 64, and a driving device 54. The difference between this embodiment and the toy car set 10 of FIG. 1 is the camera system 64 is located on the driving device 54, which is fixed on the housing 62 of the toy car 60. The driving device 54 drives the camera system 64 to direct right or left, and the rear vision mirrors 70 that cooperate with the camera system 64 is fixed on the camera system 64 to move synchronously with the camera system 64. The remote control device 80 includes a display 82 and a remote control module 88 both electrically connected with a second radio module 86 within the remote control device 80.

By the remote control device 80, the user not only controls the driving force device 68 but also the driving device 54 to drive the camera system 64 and rear vision mirrors 70. Commands of the remote control module 88 is transferred to the second radio module 86 as control signals 74, followed by the transferring of the control signals from the second radio module 86 to the first radio module 66 to control the driving device force 68 or the driving device 54. As a result, remote control of the operations of the toy car 60 as well as of the driving device 54 is achieved to change the direction of the camera system 64. Similar to the embodiment 10 of the present invention, images taken by the camera system 64 is transferred to the first radio module 66 as image signals 72, which are then transferred to the second radio module 86 by the first radio module 66. After receiving the image signals 72, the second radio module 86 transfers the image signals 72 to the display 82 for self-display of the images taken by the camera system 64. Also, with the setting of rear vision mirrors 70 fixed on the camera system 64, the user can view what is along the direction opposite to the movement direction of the toy car 60.

Figure 4:
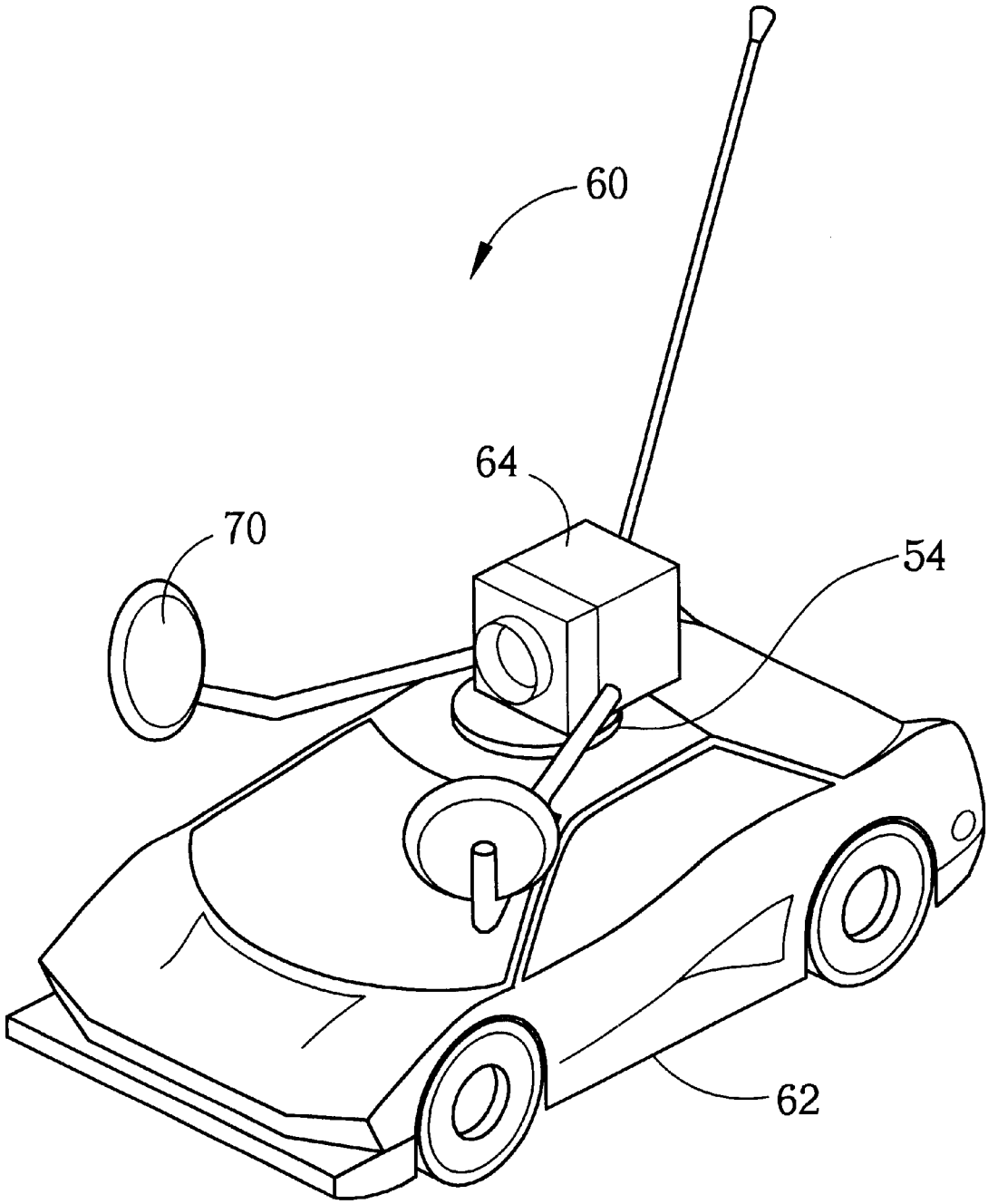
FIG. 4 is a schematic diagram of the toy car of the toy car set in FIG. 3.

Please refer to FIG. 4 of a schematic diagram of the toy car 60. The housing 62 of the toy car 60 is set the driving device 54 to drive the camera system 64 to direct right or left. Also, rear vision mirrors 70, cooperating with the camera system 64, are fixed on the camera system 64 a to reflect what is behind the toy car 60.

Figure 5:
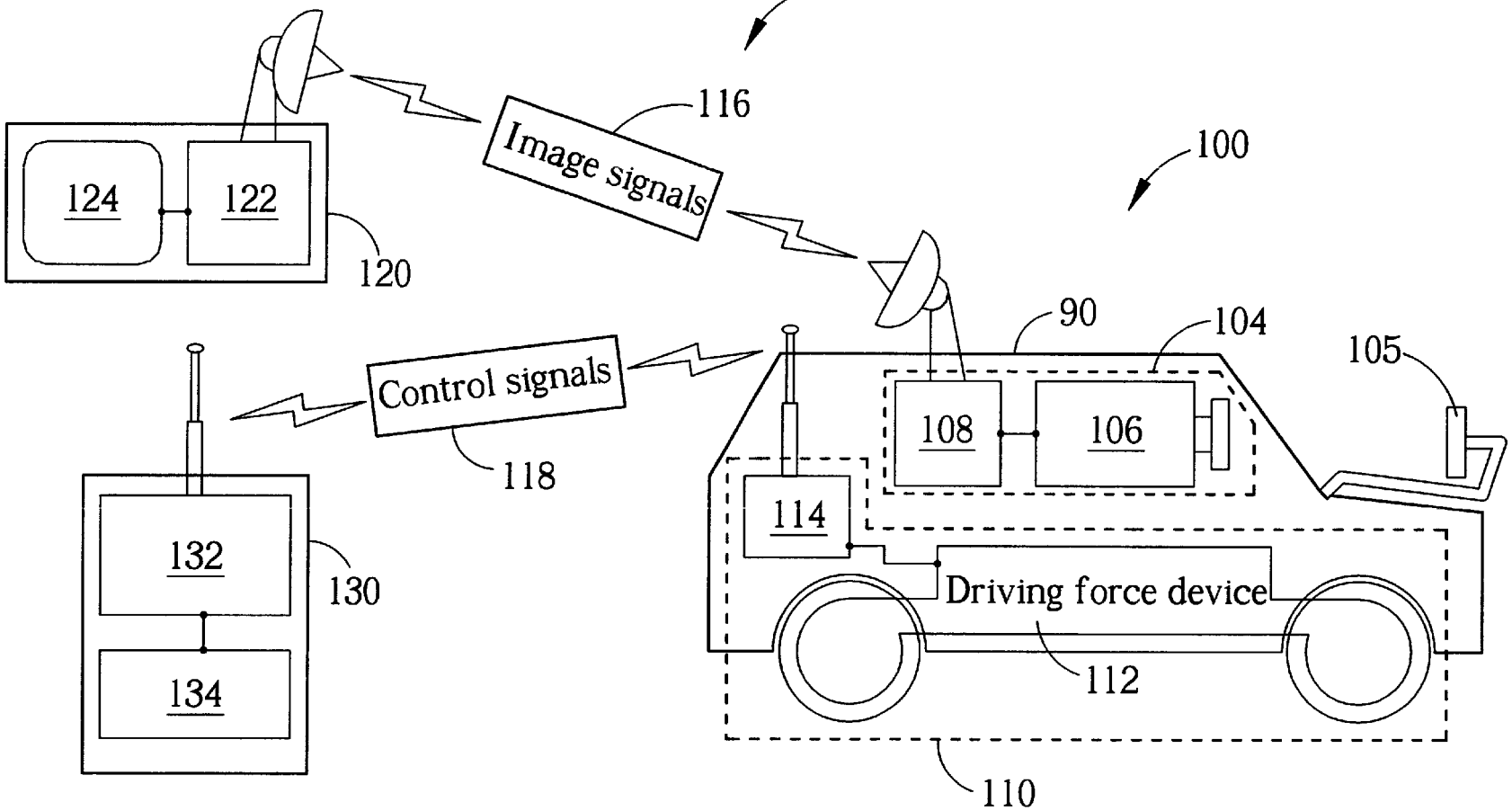
FIG. 5 is a block diagram of the third embodiment of the toy car set according to the present invention.

Please refer to FIG. 5 of a block diagram of the third embodiment of the present invention. The third embodiment includes a toy car 100, a display system 120, and a remote control device 130. The toy car 100 includes a camera system 104 with a camera device 106 and a first radio module 108 electrically connected together, and a driving system 110. The driving system 110 includes a driving force device 112 and a second radio module 114 also electrically connected together. Furthermore, the display system 120 includes a fourth radio module 122 and a display 124, and the remote control device 130 includes a third radio module 132 and a remote control interface 134 electrically connected together.

The difference between the present embodiment and the two other embodiments discussed above is that image signals 116 displayed on the display 124 and the control signals 118 for controlling the driving force device 112 are both received and transferred by different radio modules. When controlling the remote control interface 134 of the remote control device 130, the remote control interface 134 generates control signals 118 to the third radio module 132, and then the third radio module 132 transfers the control signals 118 to the second radio module 114. After receiving the control signals 118, the second radio module 114 transfers the control signals 118 to the driving force device 112 to control the operations of the driving force device 112.

The camera device 106 of the camera system 104 takes images ahead of the toy car 100 and sends corresponding image signals 116 to the first radio module 108, followed by the transfer of the image signals 116 to the fourth radio module 122. After receiving image signals 116, the fourth radio module 122 transfers them to the display 124 in order to display the image signals 116 on the display 124. Similar to the two embodiments discussed above, rear vision mirrors 105 are also set on the toy car 105 to reflect images behind the toy car 100 to the camera device 106 for display on the display 124.

In this embodiment, both the image signals 116 and control signals 118 are received and transferred by different radio module. The advantage of this arrangement is that such a circuit can be implemented according to existing circuitry.

Figure 6:
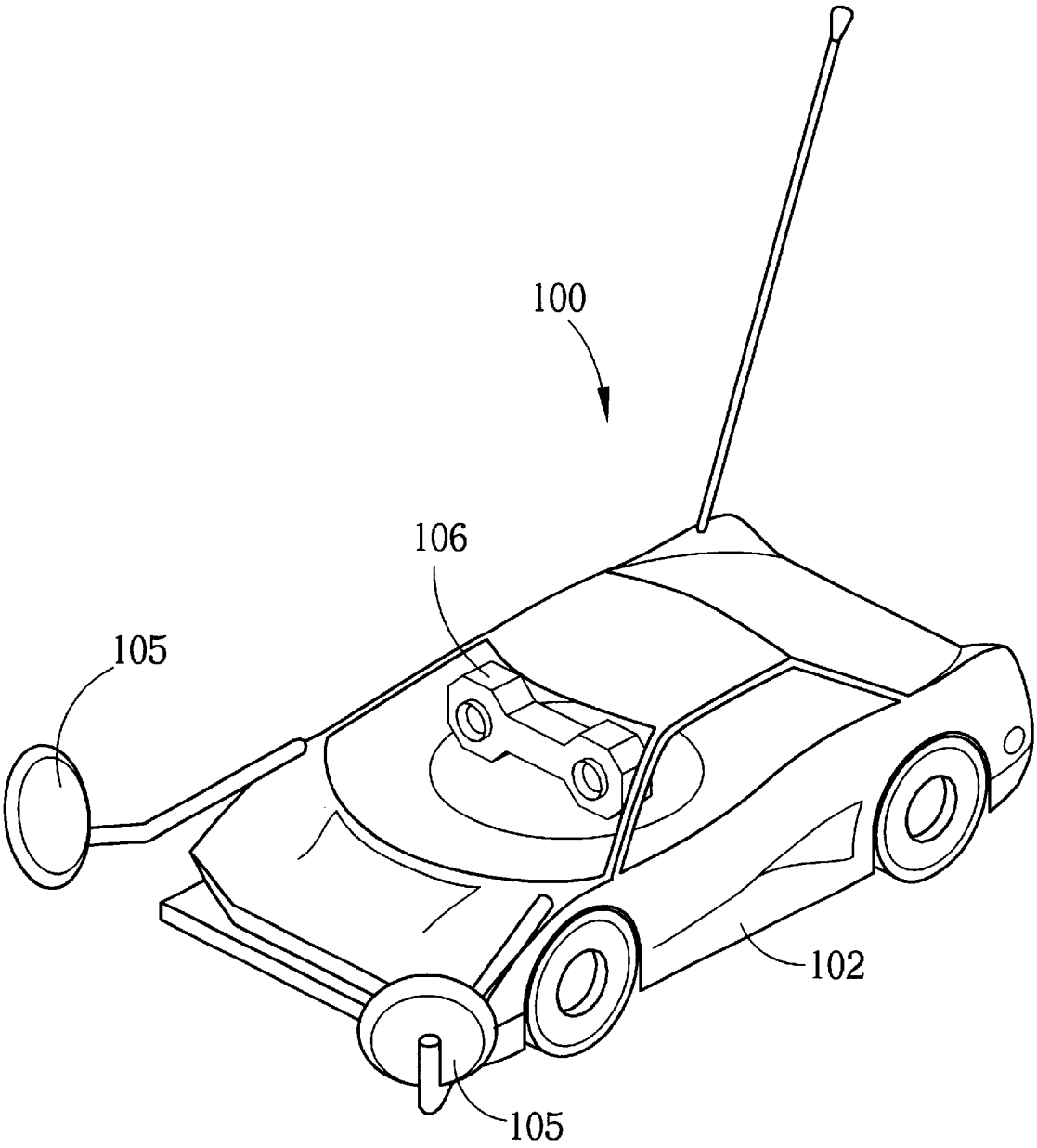
FIG. 6 is a schematic diagram of the toy car of the toy car set in FIG. 5.

Please refer to FIG. 6 of a schematic diagram of the toy car 100 in FIG. 5. The housing 102 of the toy car 100 includes a camera device 106. In this embodiment, the camera device 106 has two lenses at different positioning for generating parallax images and rear vision mirrors 105 to reflect images behind the toy car 100 to the camera device 106 and allow the user to monitor what is behind the toy car 100.

Figure 7:
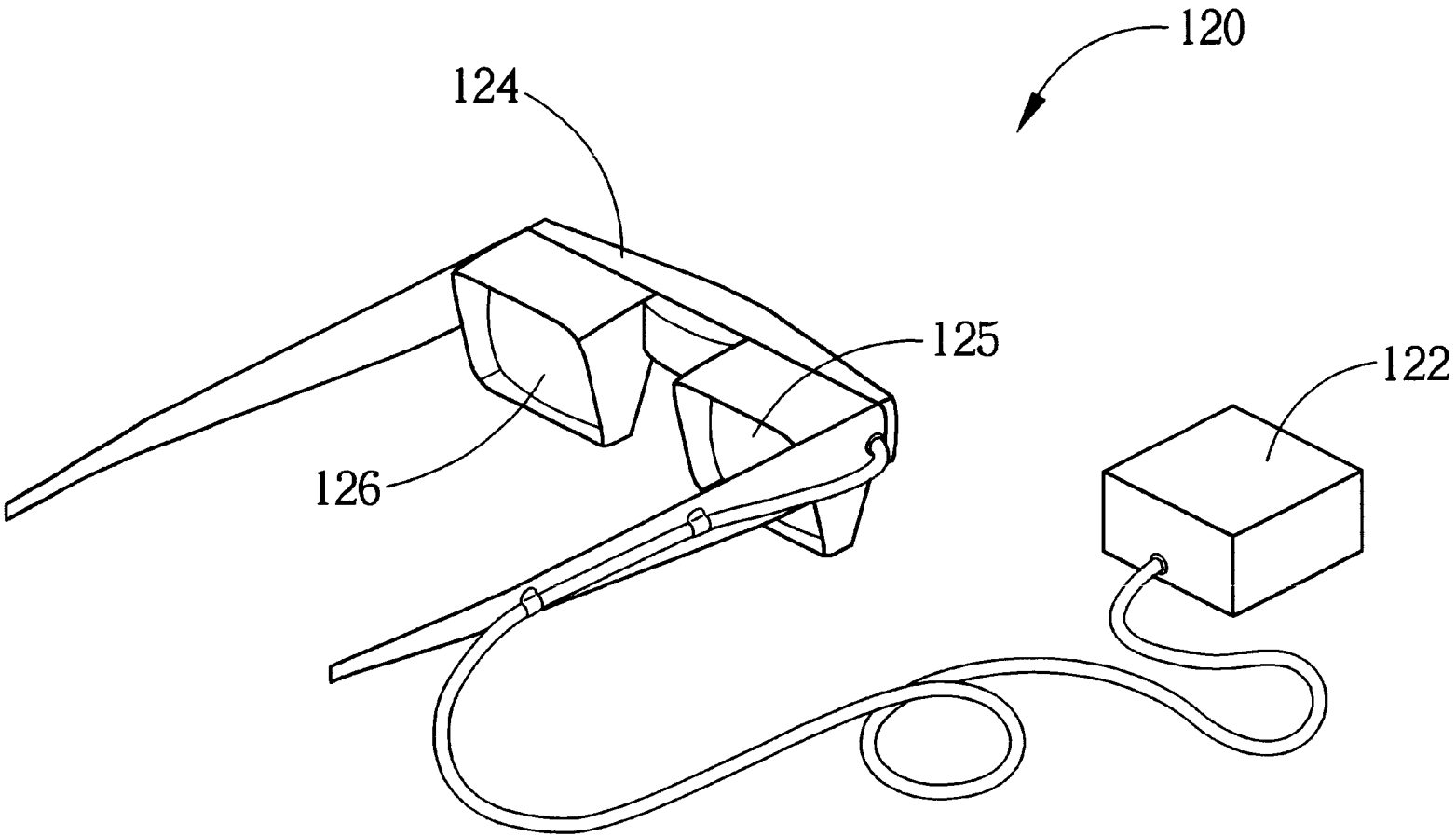
FIG. 7 is a schematic diagram of a display system of the the toy car set.

Please refer to FIG. 7 of a schematic diagram of the display system 120. The display 124 is a pair of head up display (HUD) glasses connected electrically with the fourth radio module 122 and in cooperation with two display monitors 125 and 126 on the right and left eye position, respectively. The display 120 offers a more realistic experience when controlling the toy car. Also, with the addition of the two display monitors 125 and 126, the display 124 can show 3D-like images to bring greater game-playing excitement.

The above disclosures have shown three embodiments, whereby the camera system of the present invention can be a camera system with one lens, as shown in FIG. 2, or with two lenses, as shown in FIG. 6. The display for displaying images in the present invention can be a liquid crystal display or a HUD, as shown in FIG. 7.

In contrast to the prior art, the present invention provides a toy car with a camera system and rear vision mirrors to allow the user to experience real-life car driving when controlling the toy car.

Those skilled in the art will readily observe that numerous modifications and alterations of the device may be made while retaining the teachings of the invention. Accordingly, the above disclosure should be construed as limited only by metes and bounds of the appended claims.

What is claimed is:

1. A remote-controlled toy car set comprising:

a toy car comprising:

a housing with a driving device;

a camera system for taking images and generating corresponding image signals, the camera system mounted on a camera driving device that is attached to the housing for controlling the direction of the camera system;

at least one rear vision mirror attached to the camera system for reflecting images behind the camera system to the camera system so as to allow the camera system to take images from behind the housing; and a first radio module fixed on the housing and electrically connecting with the driving device, the camera system, and the camera driving device, for transferring of the image signals from the camera system and receiving radio control signals in order to control the operations of the driving device and the camera driving device; and a remote control device for controlling the toy car comprising:

a display for displaying images;

a remote control interface for generating control signals; and a second radio module, electrically connected with the display and the remote control interface, for transferring both the image signals from the toy car to the display and the control signals from the remote control interface to the toy car;

wherein the camera system shows self-taken images on the display of the remote control device, and a user uses the remote control device to control the toy car according to the images on the display and to control the direction of the camera system.

2. The remote-controlled toy car set of claim 1 wherein the camera system comprises two cameras of different positioning for generating parallax images that are then displayed as 3-D images on the display of the remote control device.

3. A remote-controlled toy car set comprising;

a toy car comprising:

a housing;

a camera system for taking images and generating corresponding image signals, the camera system mounted on a camera driving device that is attached to the housing for controlling the direction of the camera system;

at least one rear vision mirror attached to the camera system for reflecting images behind the camera system to the camera system so as to allow the camera system to simultaneously take images both ahead of the toy car and behind the housing;

a first radio module, fixed on the housing and electrically connecting with the camera system, for transferring the image signals from the camera system;

a driving system with a driving device within the housing for driving the toy car; and a second radio module fixed on the toy car and electrically connecting with the driving device and the camera driving device for receiving control signals to control the operations of the driving device and the camera driving device; and a remote control device for controlling the toy car comprising:

a remote control interface for generating control signals; and a third radio module, electrically connected with the remote control interface, for transferring the control signals from the remote control interface to the second radio module of the toy car; and a display system comprising:

a display for displaying images, and a fourth radio module, electrically connected with the display, for receiving images signals from the first radio module of the toy car and transferring them to the display;

wherein the camera system shows self-taken images on the display of the display system, and a user uses the remote control device to control the toy car according to the images on the display and to control the direction of the camera system.

4. The remote-controlled toy car set of claim 3 wherein the camera system comprises two cameras of different positioning for generating parallax images, and the display comprises a pair of head up display (HUD) glasses for displaying 3-D images to the user.

* * * * *